US006612741B1

(12) United States Patent
Horne

(10) Patent No.: US 6,612,741 B1
(45) Date of Patent: Sep. 2, 2003

(54) SANDBAG WITH SPRING-LIKE SELF-CLOSING OPENING

(76) Inventor: James Horne, 23340 Alamos La., Newhall, CA (US) 91321-3505

( * ) Notice: Subject to any disclaimer, the term of this patent is extended or adjusted under 35 U.S.C. 154(b) by 0 days.

(21) Appl. No.: 10/306,748

(22) Filed: Nov. 27, 2002

(51) Int. Cl.[7] ..... B65D 33/24
(52) U.S. Cl. ..... 383/43; 383/36; 383/37
(58) Field of Search ..... 383/43, 34, 36, 383/98, 95, 37

(56) References Cited

U.S. PATENT DOCUMENTS

| | | | | | |
|---|---|---|---|---|---|
| 518,574 | A | | 4/1894 | Procter | 383/34 |
| 533,743 | A | * | 2/1895 | Prahar | 150/123 |
| 672,897 | A | | 4/1901 | Giltner | |
| 783,190 | A | | 2/1905 | Gibson | 150/900 |
| 940,592 | A | * | 11/1909 | Griffiths | 383/20 |
| 1,338,375 | A | | 4/1920 | Kleidman | |
| 1,406,035 | A | | 2/1922 | Kulick | 150/120 |
| 1,412,934 | A | | 4/1922 | Gorman | |
| 1,479,136 | A | | 1/1924 | Guinzburg | 383/95 |
| 1,496,462 | A | * | 6/1924 | Hunt et al. | 383/6 |
| 1,503,961 | A | | 8/1924 | Marshall | |
| 1,658,294 | A | | 2/1928 | Lewis | 150/900 |
| 2,015,473 | A | | 9/1935 | Hankel | 150/6 |
| 2,051,413 | A | | 8/1936 | Lowenstein | 150/120 |
| 2,053,496 | A | | 9/1936 | Rohr | 150/123 |
| 2,080,402 | A | | 5/1937 | Herman | 383/33 |
| 2,099,924 | A | | 11/1937 | Bressler | 150/120 |
| 2,107,216 | A | | 2/1938 | Rogers | 383/33 |
| 2,166,360 | A | | 7/1939 | Lewis | 150/120 |
| 2,695,646 | A | | 11/1954 | Van Wyk | 383/43 |
| 2,772,713 | A | | 12/1956 | Koret | 150/123 |
| 2,875,802 | A | | 3/1959 | Koret | 150/123 |
| 3,110,335 | A | | 11/1963 | Antonius | 383/43 |
| 3,163,193 | A | | 12/1964 | LaMarthe | 150/10 |
| 3,186,626 | A | | 6/1965 | Shvetz | 383/37 |
| 3,217,971 | A | | 11/1965 | Shvetz | 383/37 |
| 3,251,390 | A | | 5/1966 | Evans | 383/43 |
| 3,310,224 | A | | 3/1967 | LaGuerre | 383/44 |
| 3,552,346 | A | | 1/1971 | Garden | 141/72 |
| 3,779,449 | A | | 12/1973 | Membrino | 229/66 |
| 3,826,296 | A | | 7/1974 | Morris | 383/95 |
| 3,990,627 | A | * | 11/1976 | Olson | 383/62 |
| 4,044,921 | A | | 8/1977 | Caverly | 222/74 |
| 4,161,970 | A | | 7/1979 | Lamb | 141/114 |
| 4,184,522 | A | | 1/1980 | Waite | 141/231 |
| 4,228,834 | A | | 10/1980 | Desnick | 383/95 |
| 4,464,790 | A | | 8/1984 | Blankenship | 383/37 |
| 4,658,962 | A | | 4/1987 | Burns et al. | 206/554 |
| 4,680,808 | A | | 7/1987 | Paleschuck | 383/98 |
| 4,723,742 | A | | 2/1988 | Krauss | 248/97 |
| 4,801,081 | A | | 1/1989 | O'Connor | 383/43 |
| 4,802,582 | A | | 2/1989 | Johnson | 206/390 |

(List continued on next page.)

FOREIGN PATENT DOCUMENTS

| | | | |
|---|---|---|---|
| FR | 50827 | 4/1941 | 383/34 |

* cited by examiner

*Primary Examiner*—Jes F. Pascua
(74) *Attorney, Agent, or Firm*—Cislo & Thomas LLP

(57) ABSTRACT

A new sandbag that has a spring-like collar attached to the inside of the sandbag's mouth that forces the mouth closed. In order to fill the bag with sand the flaps that form the mouth have to be pulled apart. The self-closing feature of this sandbag can be used to automate sandbagging by having the bags packaged with one mouth flap in the open position. As the bags are removed from the stack, roll or similar packaging, the mouth flap clamps around the open-end of the source of sand, which can be similar to a funnel. After the bags are filled, they are removed, sealed shut and the next bag is put in place. The self-closing feature of this sandbag first allows for the sand to be guided into the bag, and then forces the mouth of the bag to close. The mouth can be further secured by a sealing means such as staples, thread or fiber, or hook-and-loop fastening surfaces.

7 Claims, 5 Drawing Sheets

U.S. PATENT DOCUMENTS

| | | | | | |
|---|---|---|---|---|---|
| 4,819,701 | A | | 4/1989 | Thornton | 141/231 |
| 4,838,327 | A | | 6/1989 | Ambler et al. | 383/43 |
| 4,846,586 | A | * | 7/1989 | Bruno | 383/9 |
| 4,849,090 | A | | 7/1989 | Case et al. | 206/390 |
| 4,878,764 | A | | 11/1989 | Meyer | 383/72 |
| 4,948,266 | A | | 8/1990 | Bencic | 383/34 |
| 5,000,500 | A | | 3/1991 | Almog | 383/43 |
| 5,027,578 | A | | 7/1991 | Natterer et al. | 53/390 |
| 5,044,774 | A | | 9/1991 | Bullard et al. | 383/33 |
| 5,186,988 | A | | 2/1993 | Dixon | 383/37 |
| 5,316,386 | A | * | 5/1994 | Moore | 383/10 |
| 5,346,311 | A | | 9/1994 | Siler et al. | 383/33 |
| 5,354,132 | A | | 10/1994 | Young et al. | 383/33 |
| 5,397,085 | A | | 3/1995 | Spagnolo | 248/97 |
| 5,425,403 | A | | 6/1995 | Herrmann | 141/314 |
| 5,472,271 | A | | 12/1995 | Bowers et al. | 383/43 |
| 5,544,466 | A | | 8/1996 | Bonnet | 53/138.7 |
| 5,575,315 | A | | 11/1996 | Wengert | 141/109 |
| 5,609,419 | A | | 3/1997 | Byers, Jr. | 383/33 |
| 5,647,670 | A | | 7/1997 | Iscovich | 383/33 |
| 5,704,192 | A | | 1/1998 | Jostler et al. | 141/114 |
| 5,817,379 | A | | 10/1998 | Rich et al. | 383/95 |
| 5,852,830 | A | | 12/1998 | Horn | 383/33 |
| 5,897,208 | A | | 4/1999 | Tokuda | 383/34 |
| 5,988,879 | A | | 11/1999 | Bredderman et al. | 383/13 |
| 6,022,144 | A | | 2/2000 | Hausslein | 383/33 |
| 6,164,821 | A | | 12/2000 | Randall | 383/34 |
| 6,234,674 | B1 | | 5/2001 | Byers, Jr. | 383/33 |
| 6,254,273 | B1 | * | 7/2001 | Galomb et al. | 383/63 |
| 6,269,849 | B1 | | 8/2001 | Fields, Jr. | 141/114 |

* cited by examiner

SANDBAG WITH SPRING-LIKE SELF-CLOSING OPENING

BACKGROUND OF THE INVENTION

1. Field of the Invention

This invention relates to a sandbag and a method of using it to fill the bags with sand in a continuous mechanized manner. This invention is more particularly concerned with 1) a bag that has a resilient and spring-like collar that allows for quick closure of the bag's mouth, and with 2) the use of these bags to automate the sandbagging process so that the user can produce properly sealed sandbags through a series of automated steps.

2. Description of the Related Art

Several patents have been used for inventions that aid in sandbagging or provide partial automation, however no patent has been used on a method or apparatus that fully automates the sandbagging process.

Sandbagging has been and continues to be a solution to flooding, especially in sensitive emergency conditions. Unfortunately, the process of making sandbags has primarily consisted of having individuals manually shovel sand into bags and seal them. This is a time consuming and physically exhausting process. Furthermore, the manual production of sandbags is not an efficient method of preparing for a flood.

Other inventions partially automating the sandbagging process primarily focus on using a hopper and some guiding mechanism, such as a conveyor or a funnel, to direct sand into bags. U.S. Pat. Nos. 3,552,346, 4,044,921, 4,184,522, 4,819,701, and 5,425,403 disclose inventions that use hoppers or other guiding means. These inventions, however, require a person to feed the bags into the machine's holding means, direct the bags under the funneling element, and then staple or otherwise seal the open-end of the bag. Other inventions have dealt with a guiding or support means that facilitates directing the sand into a bag. U.S. Pat. Nos. 4,743,742, 5,397,085 and 5,575,315 concern a shovel with a sandbag gripping means and two sandbag support structures respectively. Although these inventions save some time and eliminate the need for shoveling sand, they still require human labor to produce a properly filled and sealed sandbag.

The invention concerns a self-closing bag that facilitates the sandbagging process. Other inventions have disclosed bags that are continuously connected in a roll, bags that have a support structure integrated into the mouth of the bags, or bags with drawstrings. U.S. Pat. Nos. 518,574, 672,897, 1,338,375, 1,412,934, 1,503,961, 2,015,473, and 3,163,193 disclose bags with support structures integrated into the mouth of the bag so that the mouth can be easily closed. None of these patents, however, concern a self-closing bag. U.S. Pat. No. 4,878,764 discloses a bag with a drawstring-closing means that requires a person to manually pull on the string to close the mouth. U.S. Pat. Nos. 4,802,582 and 4,849,090 disclose inventions for continuously-connected bags that can be regularly stored in rolls, but do not concern self-closing bags.

It is of tremendous use for homeowners, cities and other governmental agencies to be able to produce tens of thousands of sandbags in a few hours, without the need to recruit hundreds of people to work in rainy or otherwise difficult environments. Property worth millions of dollars could be saved if sandbags were easily and quickly available. In recent years, floods have caused tens of millions of dollars in damages, and have required millions of sandbags to prevent even greater damage. All of these bags were filled one at a time by individuals.

An automated method of producing sandbags would save millions of man-hours of time and effort, and tens of millions of dollars of property damage.

SUMMARY OF THE INVENTION

This invention is for a bag that by its structure allows for an automated process of filling, sealing and stacking bags in a simple and inexpensive way. The object of this invention is to produce bags, and more specifically sandbags that facilitate the sandbagging process and allow for a method of producing sandbags with little or no human involvement. Although the invention described in this application can be used with bags made of different materials and the bags can be filled with many kinds of materials, sand and sandbags will be used as examples to illustrate one important application of the invention.

The sandbag can be made of many materials (such as hemp, plastic or other similarly flexible materials) and has a bottom, side walls (belonging to a tubular or multi-sided structure), and a mouth. The mouth is formed by two opposing flaps that are not connected to each other at their sides. The mouth can be opened by pulling the flaps in opposite directions. Because the flaps are not connected at the sides, they can be folded over to rest on the side walls of the sandbag.

The unique feature of this invention is the use of a flexible spring-like collar stay inserted around both mouth flaps of the sandbag, such that when the mouth is opened by pulling the flaps away from each other they will want to spring shut. The mouth opening is designed as a flap that opens along the top length of the bag, and therefore, is only joined to the rest of the bag along its transverse width. The collar stay is inserted into the mouth opening along the periphery of the flaps. The collar stay can be made from plastic, spring metal, or other similar material, and has the ability to bend up to 180°.

The bags can be stacked (or rolled) on top of each other with one flap in the open position, which means that the spring-like collar is bent 180° from its resting position when the bags are stacked. Because the collar stays are designed to be at the least tension, i.e. at rest, in the closed position, as soon as pressure is removed from the top of each bag, the mouth flaps will suddenly spring back to the closed position. The sandbags can be packaged with one flap in the open position to be used in an automated sandbagging method that will use the bag's ability to close its mouth to fill and seal the sandbag. The mouth will be secured shut by a sealing means such as that produced by two surfaces that when pushed together adhere to one another. An example is where one surface is made of small plastic loops and the other consists of many fibers that will insert into the many loops when pressed into them. One such sealing means is currently sold under the Velcro® trademark. For simplicity, this general type of sealing means will be referred to herein generally as hook-and-loop fastener.

The second object of this invention is to provide a method of automating the sandbag production by using the specially designed sandbags in a series of steps that removes one bag at a time from a stack or roll of bags that have been packaged with the mouth flaps in the open position. One bag is removed from the stack or roll and, with the mouth flap held open, is pulled towards the opening of a funnel-like sand feeder. As the bag nears the feeder's open end, the open flap closes around the top side of the feeder's open end. After having the mouth clamp around the feeder's open end, it is filled with the proper amount of sand without spilling from its sides. As the sandbag fills with sand, its weight pulls it down a sloped ramp towards a collection area. The sandbags are connected to each other in such a way that as one bag fills with sand and slides down the ramp, it pulls the next sandbag towards the feeder's open end and allows for the next bag to fill. The connection between the bags is cut as the bags go into the collection area. This method of filling sandbags can also include a means of stacking or piling the bags to the side of the apparatus that uses this sandbagging method.

More specifically, one embodiment of the method comprises a continuous supply of bags fed through a narrow-enough passageway that continues to hold the mouth flap in the open position. The open end of the funnel-like feeder rests on top of the end of the narrow passageway such that the sandbag slides out of the passageway with the bottom end first. As the mouth flap comes out of the passageway it begins to spring shut because the passageway structure is no longer holding it open. Because the feeder's open end is above the passageway and is designed to fit inside the mouth of the sandbag, the mouth flap closes around the feeder's open end so that the sand that flows through the feeder goes directly into the sandbag. A means of regulating the amount of sand per bag can be added so that a set volume of sand is placed in each bag within a set period of time. By controlling the volume and flow rate of the sand, each sandbag can be adequately filled before it starts sliding away from the feeder. Whether or not there is a volume or rate control on the feeder, the flow of sand will stop, by a closing means, after the sandbag slides away from the feeder so that sand is not spilling on top of the next sandbag before it is in place.

As the bags are pulling away from the feeder, the mouth flaps come together and close the mouth. In order to secure the seal and prevent sand from being forced out, a sealing means is added to the periphery of the mouth flaps. As discussed above, a hook-and-loop fastener is one such sealing means that can be added to the mouth flaps to adequately seal the flaps together to prevent sand from opening the bag during regular use. Staples, threads, clamps and drawstrings are some examples of other securing means.

These and other features, aspects and advantages of the present invention will become better understood with reference to the following drawings, description and claims.

DESCRIPTION OF THE PREFERRED EMBODIMENT(S)

The detailed description set forth below in connection with the appended drawings is intended as a description of presently-preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Figure 1:
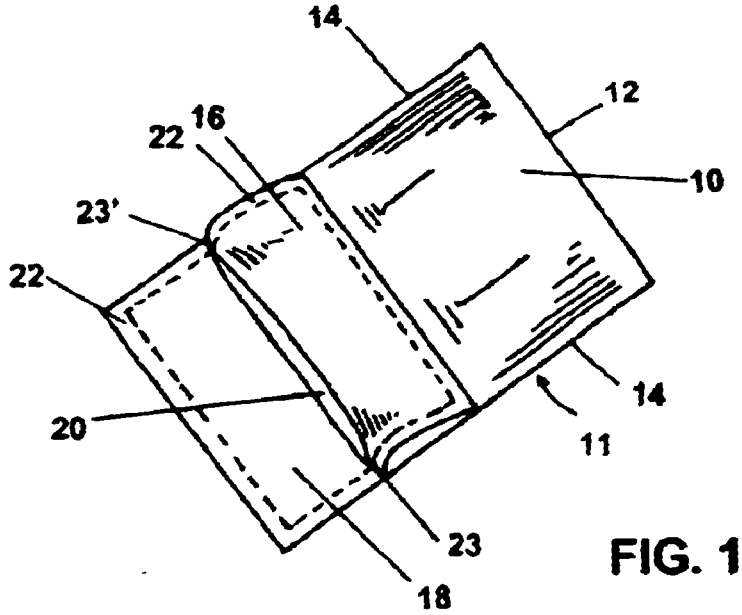
FIG. 1 is a top view of the sandbag with one mouth flap in the open position.
Figure 2A:
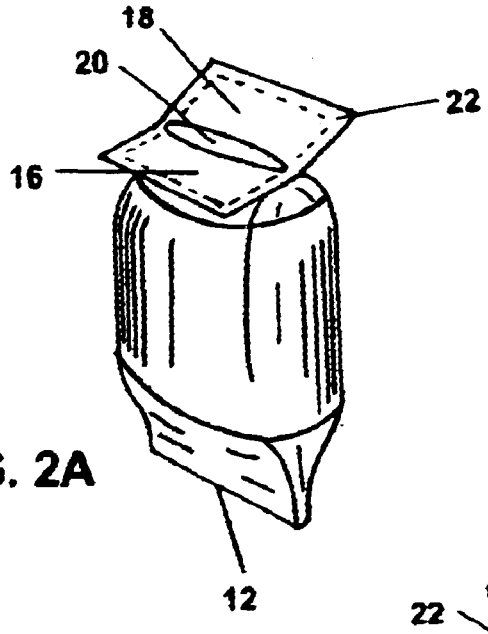
FIG. 2A is a frontal perspective view of a tubular sandbag, similar to that of FIG. 1, with an open mouth and attached flaps.
Figure 2B:
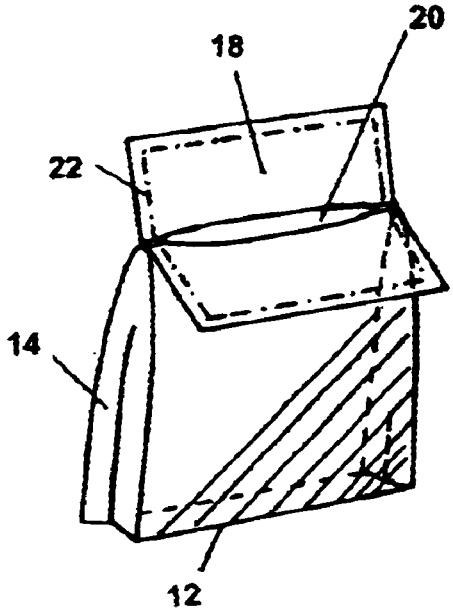
FIG. 2B is a frontal perspective view of a multi-sided sandbag with an open mouth and attached flaps.

Referring to the above-mentioned drawings, the following is a more detailed description of several embodiments of the invention. Although this invention can be used for purposes other than sandbags, the references in this application will be made to sandbags. FIG. 1 shows a sandbag with a mouth 20, bottom end 12 and sides 14. The mouth 20 is formed by two flaps 16 and 18 that lie on top of each other when the mouth of the sandbag is closed. As in most bags, whether made of tubular material or a multi-sided structure, the sandbag will have opposing face panels 10. FIGS. 2A and 2B show examples of tubular and multi-sided bags. The sides 14 of a tubular bag are usually referred to the area that extends longitudinally from the side-ends 23 of the mouth 22 to the bottom of the sandbag. The sides 14 are more evident when the bags are stacked so that the mouth flaps can easily lie open or closed (see FIG. 4).

Sandbags can be constructed from canvas, fused plastic sheets, woven plastic, or other similar materials. Usually when the plastic sheets are used and fused together to form the bag, then the fused section of the bag should correspond to the sides 14 of the sandbag, which extends from the side-ends 23 to the bottom 12 of the sandbag.

As shown in FIG. 1, the sandbag has a self-closing mechanism in the mouth area so that when one flap is pulled away from the opposing flap there is a spring-like force pulling the flaps back together. One embodiment of the self-closing mechanism is spring-like collar 22 that is inserted along the inside periphery of the flaps. The spring-like collar 22 can be constructed of a one-piece flexibly resilient plastic or steel that bends at the point where the flaps connect 24. Spring steel would be an example of such flexibly resilient steel.

Figure 5A:
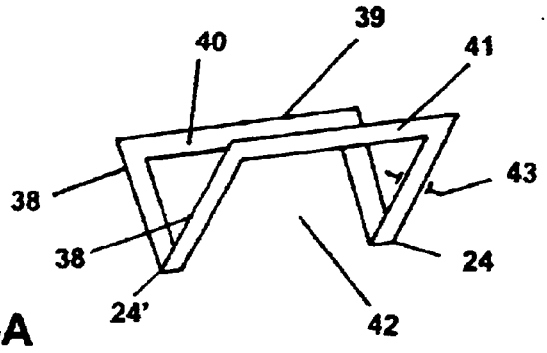
FIG. 5A is a longitudinal perspective view of the spring-like collar stay in a partially closed state.

The spring-like collar 22 has two opposing panels that press against each other in order to keep the mouth 20 of the sandbag closed. FIG. 5A shows a partially open spring-like collar 22 that is constructed from material such as steel. The opening face panels 40 and 41 in the version shown in FIG.

5A have material on three sides. Therefore, when the panels are folded, an opening 42 is created. When the panels are opened 180° from each other, a rectangular opening 47 is seen.

Figure 5B:
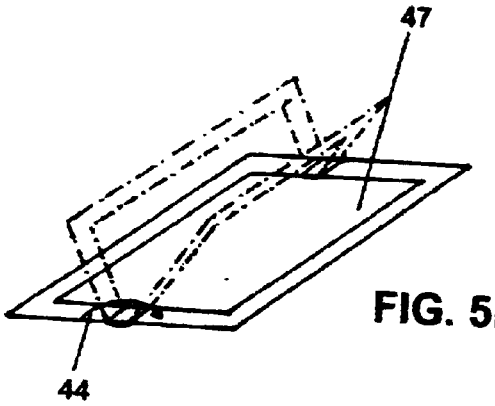
FIG. 5B is a longitudinal view of the spring-like collar stay in a fully open state.
Figure 5C:
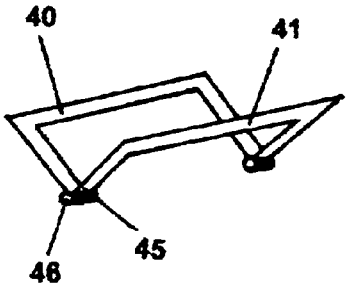
FIG. 5C is a longitudinal perspective view of a spring-like collar stay with a coil spring joint.
Figure 5D:
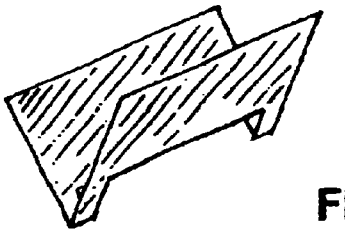
FIG. 5D is a perspective view of a spring-like collar as in FIG. 5A except with solid face panels.
Figure 7:
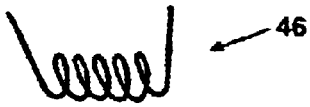
FIG. 7 is a perspective view of coiled spring 46.

The opposing face panels 40 and 41 can be made with varying widths 43 and sized with openings 47 of different sizes. The primary purpose of the spring-like collar 22 is to allow the mouth 20 of the sandbag to be pulled open and then have mouth flaps 16 and 18 self-close. Therefore, the top elements 39 and side elements 38 of the opposing face panels 40 and 41 can be one (1) inch wide or, shown in FIG. 5D, each panel can almost be a solid sheet. As shown in FIG. 5C, a spring-like collar 22 can be constructed from opposing face panels 40 and 41 that are connected to a coiled spring mechanism 46 at ends 45. See also FIG. 7 for an example of a coiled spring. The coiled spring mechanism 46 pulls the opposing face panels 40 and 41 together. FIG. 5B shows a spring-like collar 22 in the open position. The spring-like collar 22 can be opened as much as 180°. This means that the opening face panels 40 and 41 can be pulled away from each other so that they are lying flat and in approximately the same surface plane.

Figure 8A:
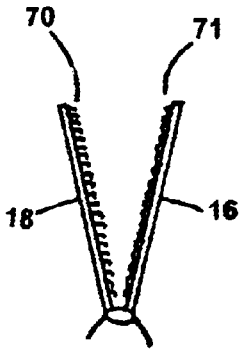
FIG. 8A is a side view of a sealing means that uses fiber and loops (to form generally a hook-and-loop fastener).
Figure 8B:
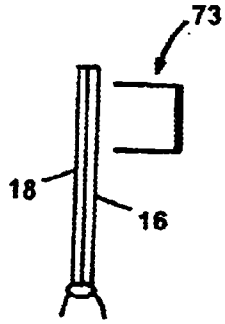
FIG. 8B is an exploded side view of a sealing means that uses a staple to secure the sandbag's opening.
Figure 8C:
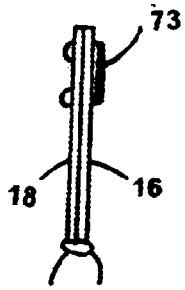
FIG. 8C is a side view of a sealing means using a staple as contemplated in one embodiment of the present invention in which the staple has been closed to secure the sandbag opening.

The spring-like collar 22 must cover the periphery of the flaps so that when the flaps close, the edge of the flaps are aligned properly and firmly to prevent the sand from escaping. Although the force from the spring-like collar 22 may be able to hold the mouth 20 closed, a means of sealing the mouth should be added. A sealing means such as a hook-and-loop fastener can be added to the inside of the flap so that when the flaps close against each other, the two surfaces of the hook-and-loop fastener engage each other and secure the mouth shut. FIG. 8A shows the fiber 70 and loop 71 structure that allow for two surfaces to seal just similar to the current marketed version of a hook-and-loop fastener. The hook-and-loop fastener can be effectively placed along the periphery of the flaps similar to the spring-like collar 22. Other sealing means such as staples or stitches can be added along the transverse width of the mouth. FIG. 8B demonstrates how a staple 73 can push through the bag and seal it shut.

By attaching the spring-like collar 22 to the inside of the mouth flaps of the sandbag, a self-closing bag has been created that will facilitate filling, closing and securing the sandbag in a series of steps. In order to automate the sandbag (or most other types of bagging) the bags must be packaged in a way that they can be easily used as part of an automated method of sandbagging.

Figure 3:
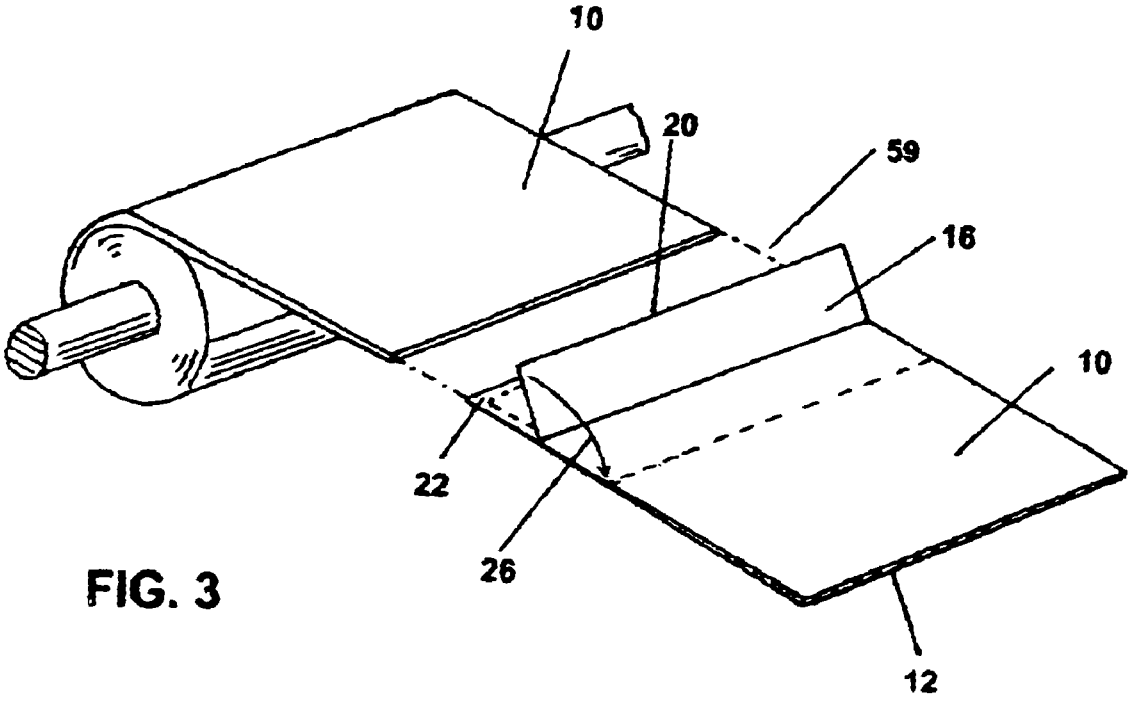
FIG. 3 is a longitudinal perspective view of a roll of continuously-connected sandbags.
Figure 4:
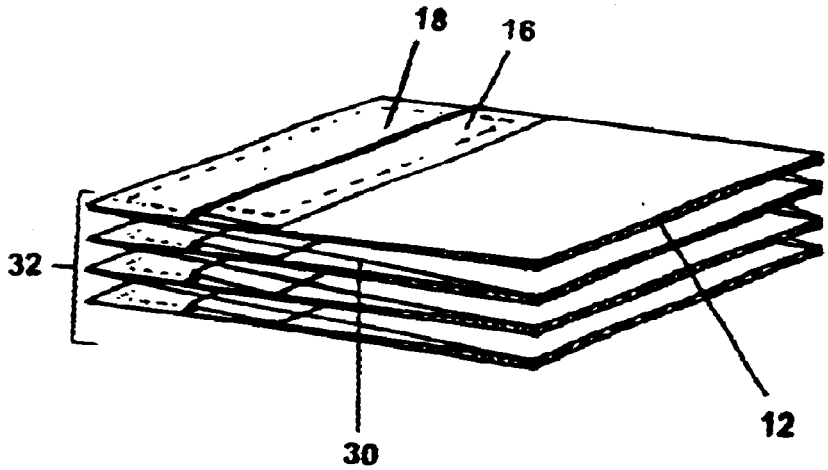
FIG. 4 is a perspective view of a stack of individual sandbags, as seen in FIG. 1, connected to each other with a connecting means.

Two packaging possibilities are shown in FIGS. 3 and 4. FIG. 3 shows a roll of sandbags that are attached to each other with a simple connecting string or thread 59, and are arranged such that the bottom unrolls first. Before the bags are rolled in layers, the top flap 16 is opened 26 and kept open by the next bag that is rolled on top of it. Such a string or thread (59 and 30) connection is connecting means for attaching one bag to another. A second way of storing the self-closing sandbags is shown in FIG. 4. The sandbags are stacked 32 on top of each other with the top flap 16 held in the open position by placing another bag on top of the previous bag. The stacking is continued until the desired number of bags have been stacked 32 on top of each other with all of their top flaps 16 in the open position. The first bag must have its flap held open by some other means such as the top of the box that contains the stack of bags. Each bag is connected to the next by a connecting means 30 (which can be thread). The bags will be pulled one at a time from the bottom 12 and fed into the sandbagging apparatus.

Figure 6:
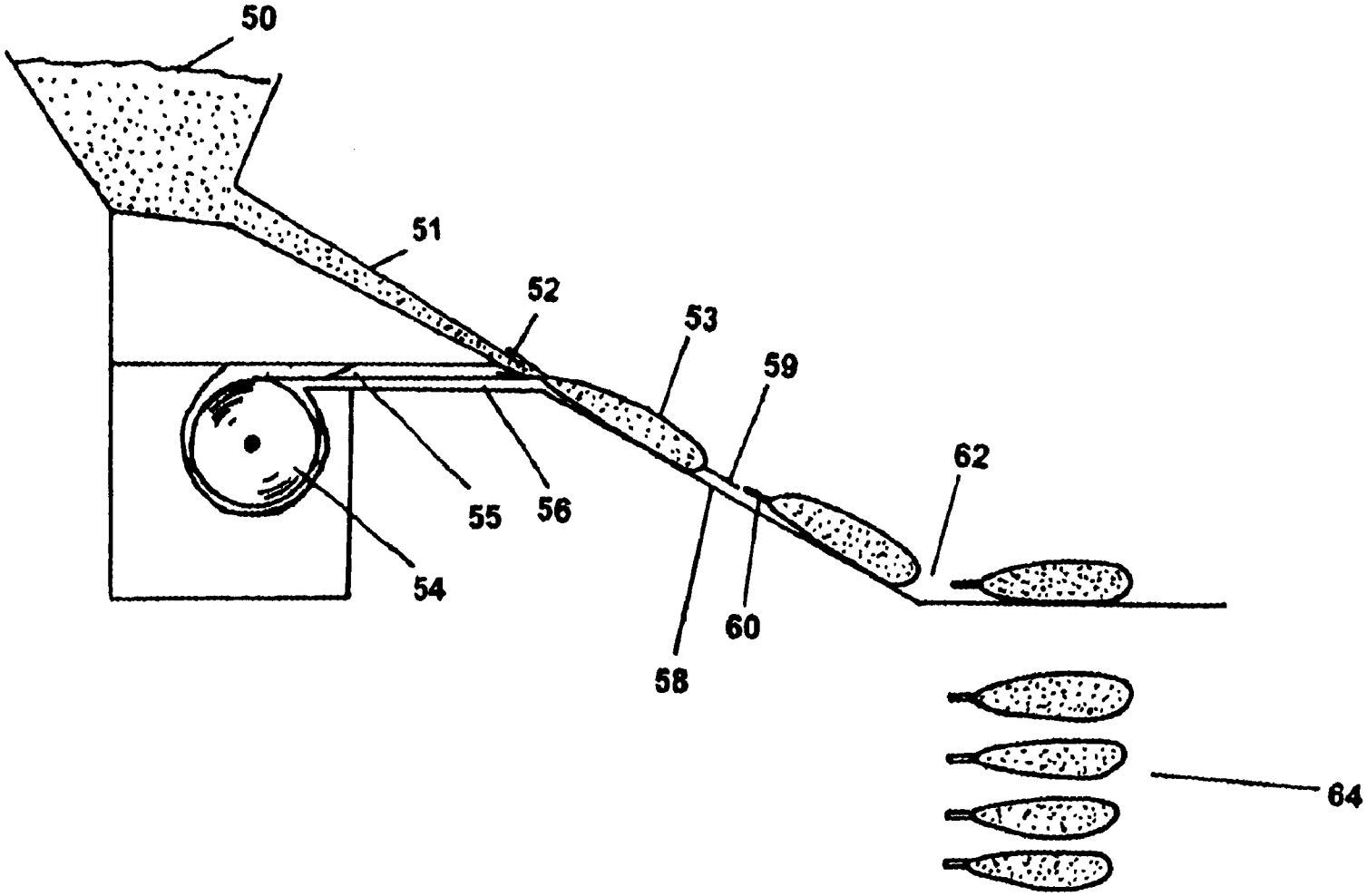
FIG. 6 is a diagram illustrating the method of use of the self-closing sandbag.

The method of using the self-closing sandbag requires a series of steps that are illustrated in FIG. 6. The source of bags 54 can either be a roll of bags or stack of bags as described above. The sandbag is pulled bottom 12 first such that as it is pulled through passage 56 the flap 16 is held open 55 during the time that it is passing through. As the sandbag is pulled out of the passage 56 the top flap closes around the source of the sand 52. The sand 50 is allowed to pour 51 into the sandbag. As the sandbag reaches a certain weight, it begins to slide down slope 58. The cause of the sliding can be gravity, a conveyor belt or a combination of the two. After the bag slides away from the source of sand 52, the mouth self-closes 60. The connecting means 59 between the bags is cut 62 and the bags are then collected 64. The method comprises the simple steps of pulling bags from a source of bags 54 that have the bags arranged with the bottom end first, closing the mouth of the bags around the source of sand 52, moving the bag away from the source of sand 52 and closing the bag's mouth. By using the self-closing collar, the closing the mouth around the source of sand step and the closing of the mouth step are accomplished by the spring-like collar 22 by moving the bag in a continuous manner. The method can be accomplished by designing an apparatus that uses a motorized bag feeder, or a conveyor belt located in place of the sloped surface 58, or a simple gravity-driven apparatus that allows a continuous flow of bags to fill once the first bag is filled.

While the present invention has been described with regards to particular embodiments, it is recognized that additional variations of the present invention may be devised without departing from the inventive concept.

What is claimed is:

1. A self-closing sandbag comprising:

a. a pair of opposed face panels;

b. an open mouth;

c. a closed bottom opposite the open mouth;

d. the mouth being formed by two opposed face flaps that are connected to the opposed face panels, said flaps being opened away from each other approximately 180° apart, such that one lies on the outer surface of one of said opposed face panels;

e. a spring collar that is attached to the inside of the two opposed face flaps such that the flaps are forced to the closed position by the spring action of the collar; and f. connecting means that connect one sandbag to the next bag in a continuous sequence.

2. A self-closing sandbag as in claim 1, wherein the spring collar consists:

two opposed collar face panels having side elements and connect to each other at one end of said side elements to form a connection joint; and wherein said connection joint has a spring action that forces the opposed collar face panels toward each other so that said opposed collar face panels press against each other.

3. A self-closing sandbag as in claim 2 wherein the connection joints of the opposed collar face panels comprise a coiled spring structure.

4. A self-closing sandbag as in claim 1, wherein the opposed face panels and flaps are made of a plastic material.

5. A self-closing sandbag as in claim 1, wherein the opposed face sheets of the spring collar can open at 180° from each other and spring back to the closed position where the face panels are pressing against each other.

6. A self-closing sandbag as in claim 1, wherein the spring collar is attached to the two flaps by overlapping material from the flaps around the collar's U-shaped structure and securing the overlapped material to each of the flaps.

7. A self-closing sandbag as in claim 1, wherein the spring collar is made from spring steel.

* * * * *